US006264525B1

(12) United States Patent
Guschlbauer

(10) Patent No.: US 6,264,525 B1
(45) **Date of Patent: *Jul. 24, 2001**

(54) DOLL STAND

(76) Inventor: Franz Guschlbauer, Johann-Strauss Gasse 52, 2340 Mödling (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/232,867

(22) Filed: Jan. 15, 1999

Related U.S. Application Data

(63) Continuation of application No. PCT/AT98/00124, filed on May 12, 1998.

(30) Foreign Application Priority Data

May 15, 1997 (AT) ..... 836/97

(51) Int. Cl.[7] ..... A63H 3/50
(52) U.S. Cl. ..... 446/268; 248/125.8; 248/188.5
(58) Field of Search ..... 446/73, 268; 248/125.8, 248/161, 159, 188.5

(56) References Cited

U.S. PATENT DOCUMENTS 352,161 * 11/1886 Staples .
911,893 * 2/1909 Massey .
1,505,649 * 8/1924 Levy .
2,527,152 * 10/1950 Ransom et al. .
3,313,505 * 4/1967 Petrie .
4,127,251 * 11/1978 Sapkus et al. ..... 248/176
4,706,915 * 11/1987 Cindric et al. ..... 248/122
5,549,499 * 8/1996 Foskey et al. ..... 446/268
5,588,624 * 12/1996 Woodham ..... 248/188.4
5,967,470 * 10/1999 Guschlbauer ..... 248/121

FOREIGN PATENT DOCUMENTS

9604052 * 2/1996 (WO) .

* cited by examiner

*Primary Examiner*—John A. Ricci
(74) *Attorney, Agent, or Firm*—Herbert L. Lerner; Laurence A. Greenberg; Werner H. Stemer

(57) ABSTRACT

A supporting part extends vertically between the doll's legs when the doll is placed on the doll stand. The supporting part leads vertically upward to the crotch of the doll's body and is connected, by way of its upper end, to a bearing part that is fastened on the lower part of the doll's body by adhesive bonding. The lower end of the supporting part 2 is fastened in a sleeve which is inserted in a presentation plate or similar support. The sleeve has an internal thread and a headless screw in the lower part, whereby the supporting part is fastened and vertically adjusted.

16 Claims, 1 Drawing Sheet

DOLL STAND

CROSS-REFERENCE TO RELATED APPLICATION

This is a continuation of copending international application PCT/AT98/00124, filed May 12, 1998, which designated the United States.

BACKGROUND OF THE INVENTION

FIELD OF THE INVENTION

The invention lies in the field of doll stands. Specifically, the invention relates to a doll stand for supporting (bearing and holding) a doll in the upright position. The stand has a supporting part, in particular a rod and/or a tube, which, in the use position, is positioned between the doll's legs and leads vertically upward to the lower part of the doll's body. The supporting part is thereby fastened on an element, in particular a presentation plate, which holds it in the vertical position. The upper end of the supporting part is connected, via a coupling part, to a bearing part that is to be arranged between the doll's legs and supports the doll's body from beneath.

By way of example, a doll stand with these constructional features provides the following advantages:

a) The bearing part supports the weight of the doll in the vicinity of the center of gravity and bears the weight in its entirety.

b) The legs are relieved of the task of supporting the weight of the doll and they can assume any desired positions.

c) The clothes hang naturally and are not affected in the least by the doll stand.

d) The base plate is dispensed with if the supporting part is fastened in the presentation plate or beneath the presentation plate.

e) In any position of the doll through 360°, the supporting part can be concealed by one of the doll's legs.

f) The doll can be rotated about its axis.

As a result of the fact that the base plate can be dispensed with and by virtue of the concealed supporting part, the doll has a natural overall appearance and appears to be free-standing. The underlying surface need not be level. This gives aesthetic freedom. For example, a doll can be made to look as if it is climbing a step.

A doll stand of the type is described in my published international application Wo 96/04052. That publication describes how, for example, the bearing part, which butts against the lower part of the doll's body and extends from the lower part of the doll's stomach around its bottom, is fastened on the doll's body, by way of the upwardly directed mounts arranged at its two ends, by bands. The doll is thus borne securely, and the doll is prevented from tilting at the hip joints. The downwardly directed coupling part arranged in the center of the bearing part connects the bearing part to the supporting part, which leads vertically upward between the doll's legs.

SUMMARY OF THE INVENTION

It is accordingly an object of the invention to provide a doll stand, which overcomes the above-mentioned disadvantages of the heretofore-known devices and methods of this general type. Taking particularly the above-mentioned international publication as the departure point, the invention has to following specific objects: The fastening of a bearing part, which is smaller and more straightforward to produce, on the lower part of the doll's body should be simplified and it should be possible, for doll stands without a base plate, to fasten the supporting part in the presentation plate so that both proper fastening and vertical adjustment are enabled.

With the foregoing and other objects in view there is provided, in accordance with the invention, a doll stand for supporting a doll in an upright position, the doll having legs, a torso with a lower part and a crotch. The doll stand comprises:

- a support element, such as a baseplate or a presentation plate, for example the floor of a display case, or a similar support;
- a vertical supporting part, such as a rod or a tube, having an upper end and a lower end fastened to the support element, the supporting part extending substantially vertically in between the legs of the doll from the support element to the crotch of the doll; and
- a bearing part to be attached to the lower part of the torso and in the crotch of the doll and for supporting the doll on the supporting part, the bearing part including a coupling part connecting the bearing part to the upper end of the supporting part, wherein the bearing part is fastened on the lower part of the doll's torso by adhesive bonding, i.e., by gluing.

As compared with the prior art, the invention achieves:

a) Easier fastening of the bearing part, which is smaller and more straightforward to produce, on the lower part of the doll's body.

b) For doll stands without a base plate, the supporting part can be fastened in the presentation plate with a sleeve that permits both fastening and vertical adjustment.

According to the invention, the fastening on the lower part of the doll's body is simplified in that the bearing part is fastened on the lower part of the doll's body by adhesive bonding.

In accordance with an added feature of the invention, the support element is a presentation plate supporting the supporting part in the vertical position.

In accordance with another feature of the invention, the bearing part comprises an arm projecting from the coupling part, and adhesive plates attached to the arm for adhesively bonding to the lower part of the doll's torso.

In accordance with an additional feature of the invention, which is applicable particularly for medium to large dolls, there is provided a second arm projecting forward from the coupling part diametrically opposite from the first arm for attachment to the stomach portion of the doll's torso.

In accordance with a further feature of the invention, an adhesive plate is attached to the second arm for attaching the second arm to the stomach portion of the doll's torso.

In accordance with again an added feature of the invention, the coupling part is connected to the supporting part by a screw connection, a plug-in connection, a clamping connection, or the like.

In accordance with again another feature of the invention, an adapter is connected to the coupling part for establishing the connection.

In accordance with an advantageous embodiment of the invention, a sleeve is inserted in the support element and the supporting part is fastened in the sleeve.

In accordance with again further feature of the invention, the sleeve has an upper part with a flared edge. The sleeve may be further provided with a device for preventing a rotation of the supporting part and a device for adjusting a height of the supporting part.

In accordance with yet another feature of the invention, the device for adjusting the height of the supporting part includes an internal thread formed in the sleeve and a headless screw adapted to be screwed in the internal thread.

In accordance with an alternative embodiment, the sleeve further includes an integrally formed extension and the extension is formed with an internal thread. In that case, there may be provided a headless screw for meshing with the internal thread or the lower end of the supporting part may be formed with a thread for meshing with the internal thread.

In accordance with a concomitant feature of the invention, the sleeve projects from an underside of the support element and the sleeve is formed with an external thread. A rotary drive is provided in that case with an internal thread meshing with the external thread for vertically adjusting a height of the supporting part.

Other features which are considered as characteristic for the invention, and in particular advantageous developments of the invention for fastening the supporting part in the presentation plate, are set forth in the appended claims.

Although the invention is illustrated and described herein as embodied in a doll stand, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
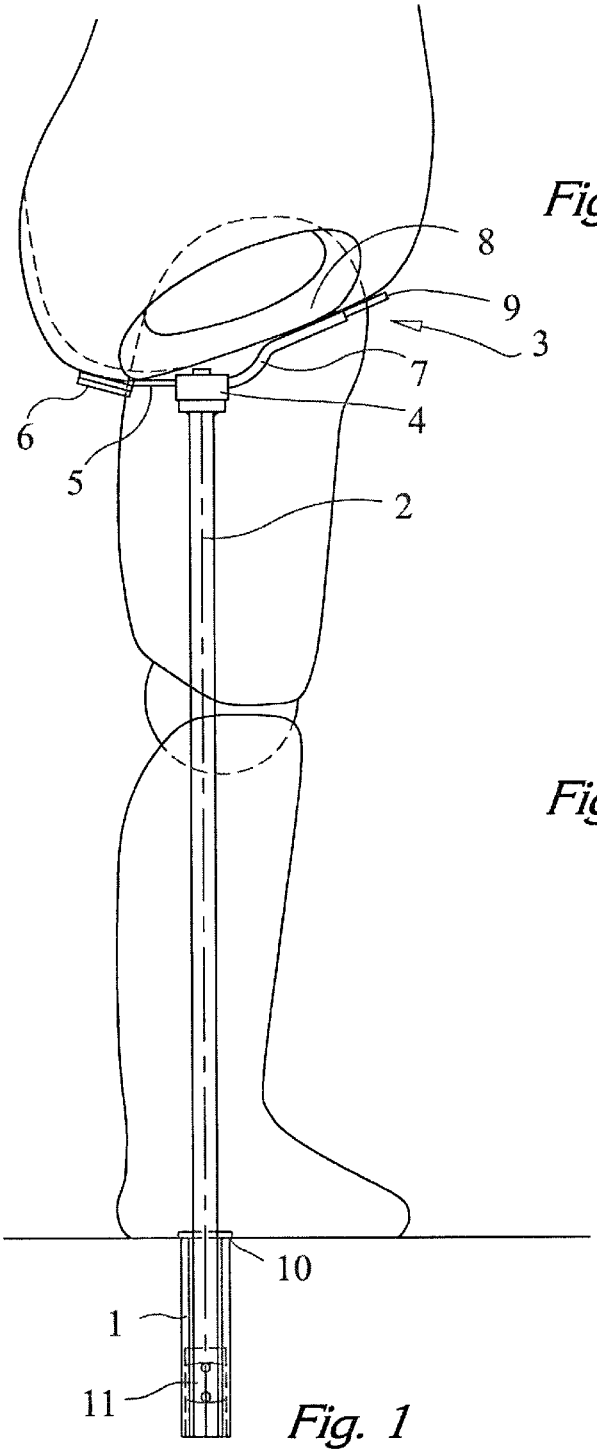
FIG. 1 is a partly diagrammatic side elevational view of a doll stand according to the invention.

Referring now to the figures of the drawing in detail and first, particularly, to FIG. 1 thereof, there is seen a partial illustration of a doll supported in a novel doll stand. The doll stand includes a vertical supporting part or support 2 mounted in a bottom sleeve 1 and extending between the legs of the doll into its crotch. There, the doll is supported on a bearing part 3 that includes a coupling part 4 connecting the bearing part to the vertical supporting part 2.

The full weight of the doll is supported on the bearing part 3. The feet of the doll, while shown to touch the support element surface, do not bear any weight. The doll's torso is supported in the crotch, whereby the central axis of the vertical supporting part 2 substantially coincides with the center of gravity vector. In other words, the doll is supported at its center of gravity.

For small to medium-sized dolls, the bearing part 3 comprises a coupling part 4, an arm 5 and adhesive plates 6.

The coupling part 4 connects the bearing part 3 with a vertical supporting part 2. The connection may be a screwed connection (e.g. by a cylindrical coupling part with internal screw thread), a plug-in connection or a clamping connection. The coupling part 4 is made of metal or plastic and, in the use position, is positioned on the lower part of the doll's body, between the legs, so as to coincide with the supporting part 2. The supporting part 2 leads vertically upward between the doll's legs. One end of the arm 5 is arranged on the coupling part 4 and in the direction of the doll's bottom. The rear arm 5 terminates in the lower part of the doll's bottom. The arm 5 is a part made of metal or plastic and has a pair of adhesive plates 6 fastened at its other end. The pair of adhesive plates 6 is made of metal or plastic as well. The term adhesive plate is used to indicate that the plates are prepared with an adhesive (e.g. hot melt adhesive, contact cement, etc.) and the doll is then glued to the arm 5 by the intermediary of the adhesive plates. One adhesive plate is provided for the doll's left buttock and the other is provided for the doll's right buttock, and they are positioned approximately in the lower part of the doll's bottom.

For medium-sized to large dolls, the bearing part 3 additionally comprises a second arm 7, if appropriate, with adhesive plate 9.

The second arm 7 likewise has one end attached to the coupling part 4, to be precise in extension of the arm 5 and terminating on the lower part of the doll's abdomen (stomach) as a support more or less in position 8 of the lower part of the doll's body, or terminating with an adhesive plate 9 on the lower part of the doll's abdomen. The arm 7 and adhesive plate 9 are likewise made of metal or plastic.

The bearing part 3 is adhesively bonded on the lower part of the doll's body by way of the pair of adhesive plates 6 and, if appropriate, of the adhesive plate 9, suitable adhesives being used in the process. This means that there is no longer any risk of tilting at the hip joints. In selecting the adhesive, it should be ensured that the coating on the doll's body is not damaged and that the adhesive can be detached without leaving any residues. If appropriate, the adhesive locations provided on the doll's body should be covered with a detachable protective film.

If the bearing parts 3 are made of metal, they can be easily and successfully attached, for example, by hot melt adhesive. The accuracy of fit of the parts to be joined does not have to meet very high standards. The surface adhesion and the inner strength allow high retaining forces to be achieved. The adhesive layer can be drawn off, starting at one corner. Hot melt adhesive is also an option for the bearing parts 3 made of plastic, but other adhesives, such as pressure-sensitive adhesive, adhesive tapes, adhesive films, contact cement, and the like, can also be used nowadays for bearing parts made of metal or plastic.

The process operation of adhesively bonding (i.e., gluing) a bearing part 3 to the lower part of the doll's body using hot melt adhesive could be performed as follows:

Preform the bearing part 3, taking into account the position of the doll and supporting part 2 (auxiliary framework or wall for support). Mark the adhesive locations. Coat the adhesive plates 6 and 9 on the adhesive side with a film of hot melt adhesive. Position the bearing part 3 on the supporting part 2 and heat. Apply hot melt adhesive to the marked locations on the doll's body and position the doll on the bearing part 3. Arrange the doll precisely and allow the adhesive to cool. The bearing part 3 is removed by heating.

As specified in my earlier international publication WO 96/04052 (PCT/AT95/00158), the supporting part 2 may be a rod, a tube or a combination of the two. The drawing FIG. 1 shows the arrangement of the doll stand for a large doll with a screwed connection between the bearing part 3 and the supporting part 2. It will be understood, however, that it is also possible to screw an adapter into the coupling part 4 in order to produce some other desired connection between the bearing part 3 and the supporting part 2.

Figure 2:
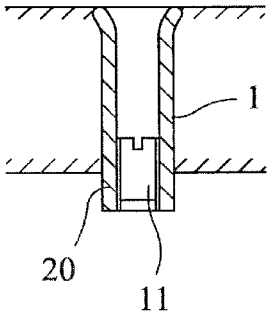
FIG. 2 is a vertical section through a first embodiment of the bearing sleeve of the invention.
Figure 3:
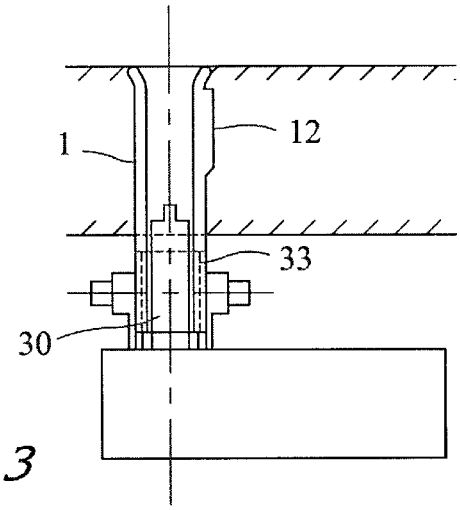
FIG. 3 is a vertical section through a second embodiment of the bearing sleeve.
Figure 3A:
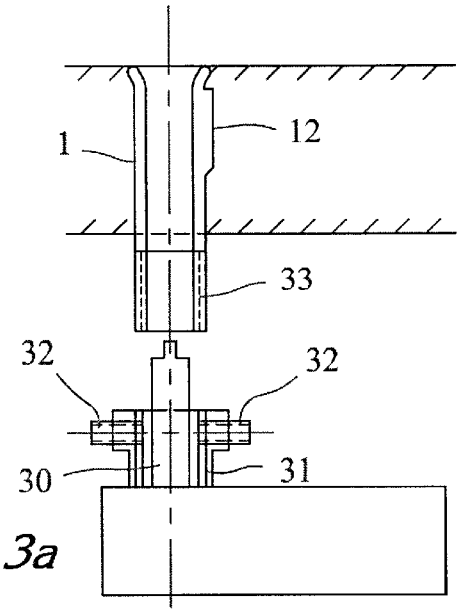

Referring now to all of the figures and, specifically, to FIG. 2, the sleeve 1 is inserted into a presentation plate or into any support plate (including the floor of the display case or display stand). The lower end of the supporting part 2 is fastened in the sleeve 1. At the top, the sleeve 1 is provided with a flared edge 10 and, if necessary or otherwise appropriate, there is also provided a rotation-preventive means 12 (FIG. 3). The lower portion of the sleeve 1 may be internally threaded so as to enable, for example with a headless screw 11 a height-adjustment. For that purpose, the internal screw 11 may be provided with engagement means at the top and bottom so that it can be screwed up and down in order to adjust the height level of the supporting part 2. If the internal thread is cut into the sleeve wall, the headless screw can only be screwed in from beneath.

In order for it also to be possible to screw in the headless screw 11 from above, the internal thread is arranged in an extension which is integral with the sleeve 1 (FIG. 2). This arrangement also makes it possible for the supporting part 2 with thread at the lower end to be screwed into the fitting internal thread for adjustment purposes. This arrangement gives a small overall length for the sleeve.

With reference to FIG. 3, the sleeve 1, projecting correspondingly on the underside of the presentation plate, may be provided not with an internal thread but with an external thread 33 in the lower part, on which it is possible to arrange in a vertically adjustable manner a rotary drive 30 provided with an internal thread 31. The position can be fixed by a locking nut or locking screw 32.

Additional information with regard to doll stands in general, and particularly with regard to the doll stand described in the introduction, may be gleaned from my earlier international publication WO 96/04052 (PCT/AT95/00158) and my U.S. Pat. No. 5,967,470. Both disclosures are herewith expressly incorporated by reference.

I claim:

1. A doll stand for supporting a doll in an upright position, the doll having legs, a torso with a lower part and a crotch, the doll stand comprising:

a support element;

a vertical supporting part having an upper and and a lower end fastened to said support element, said supporting part being adapted to extend substantially vertically in between the legs of a doll from said support element to a crotch of the doll;

a bearing part of metal to be attached to a lower part of a torso and in the crotch of the doll and for supporting the doll on said supporting part, said bearing part including a coupling part connecting said bearing part to said upper end of said supporting part; and a quantity of hot-melt adhesive for fastening said bearing part directly to the lower part of the doll's torso.

2. The doll stand according to claim 1, wherein said supporting part is a rod.

3. The doll stand according to claim 1, wherein said supporting part is a tube.

4. The doll stand according to claim 1, wherein said support element is a presentation plate supporting said supporting part in the vertical position.

5. The doll stand according to claim 1, wherein said bearing part comprises an arm projecting from said coupling part, and adhesive plates attached to said arm and carrying said quantity of adhesive for adhesively bonding to the lower part of the doll's torso.

6. The doll stand according to claim 5, wherein said arm is a first arm, and including a second arm projecting forward from said coupling part diametrically opposite from said first arm for attachment to a stomach portion of the doll's torso.

7. The doll stand according to claim 6, which further comprises an adhesive plate carrying said quantity of adhesive and being attached to said second arm for attaching said second arm to the stomach portion of the doll's torso.

8. The doll stand according to claim 1, wherein said coupling part is connected to said supporting part by a connection selected from the group consisting of a screw connection, a plug-in connection, and a clamping connection.

9. The doll stand according to claim 8, which further comprises an adapter connected to said coupling part establishing said connection.

10. The doll stand according to claim 1, which comprises a sleeve inserted in said support element, said supporting part being fastened in said sleeve.

11. The doll stand according to claim 10, wherein said sleeve has an upper part with a flared edge.

12. The doll stand according to claim 10, wherein said sleeve is provided with a device for preventing a rotation of said supporting part and a device for adjusting a height of said supporting part.

13. The doll stand according to claim 10, wherein said sleeve further includes an integrally formed extension and said extension is formed with an internal thread.

14. The doll stand according to claim 13, which further comprises a headless screw for meshing with said internal thread.

15. The doll stand according to claim 13, wherein said lower end of said supporting part is formed with a thread for meshing with said internal thread.

16. The doll stand according to claim 10, wherein said sleeve projects from an underside of said support element and said sleeve is formed with an external thread, and including a rotary drive with an internal thread meshing with said external thread for vertically adjusting a height of said supporting part.

* * * * *